US011742606B2

(12) United States Patent
Racho et al.

(10) Patent No.: US 11,742,606 B2
(45) Date of Patent: Aug. 29, 2023

(54) ELECTRICAL TERMINAL AND ELECTRICAL CONNECTOR ASSEMBLY FOR ELECTRICALLY CONDUCTIVE STRUCTURES

(71) Applicant: Lear Corporation, Southfield, MI (US)

(72) Inventors: Edgar Michael Racho, Lapu-Lapu (PH); Lewis Galligan, Novi, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 17/351,635

(22) Filed: Jun. 18, 2021

(65) Prior Publication Data

US 2022/0407258 A1 Dec. 22, 2022

(51) Int. Cl.

| | |
|---|---|
| ***H01R 13/24*** | (2006.01) |
| ***H01R 12/77*** | (2011.01) |
| ***H01R 31/06*** | (2006.01) |
| ***H01R 12/88*** | (2011.01) |

(52) U.S. Cl.

CPC ..... *H01R 13/2442* (2013.01); *H01R 12/774* (2013.01); *H01R 12/778* (2013.01); *H01R 12/88* (2013.01); *H01R 31/06* (2013.01)

(58) Field of Classification Search

CPC .. H01R 13/422; H01R 13/428; H01R 13/434; H01R 13/18; H01R 13/2442; H01R 12/59; H01R 12/79; H01R 12/88; H01R 12/774; H01R 12/778; H01R 31/06

See application file for complete search history.

(56) References Cited

U.S. PATENT DOCUMENTS

| | | | | |
|---|---|---|---|---|
| 3,920,303 | A | 11/1975 | Pillman et al. | |
| 4,235,500 | A * | 11/1980 | Belopavlovich | H01R 12/82 439/495 |
| 4,934,966 | A * | 6/1990 | D'Urso | H01R 13/20 439/850 |
| 5,308,262 | A | 5/1994 | Chishima | |
| 5,573,434 | A * | 11/1996 | Ittah | H01R 13/113 439/839 |
| 5,975,964 | A * | 11/1999 | Seko | H01R 13/18 439/857 |
| 6,280,217 | B1 * | 8/2001 | Lin | H01R 12/79 439/495 |
| 6,394,858 | B1 * | 5/2002 | Geltsch | H01R 13/114 439/852 |
| 6,682,363 | B1 | 1/2004 | Chang | |
| 7,252,559 | B1 * | 8/2007 | Morello | H01R 13/113 439/852 |
| 7,338,334 | B2 * | 3/2008 | Kumakura | H01R 43/16 29/857 |

(Continued)

*Primary Examiner* — Thanh Tam T Le

(74) *Attorney, Agent, or Firm* — MacMillan, Sobanski & Todd, LLC

(57) ABSTRACT

Electrical term finals and electrical connector assemblies for electrically conductive structures are described. An example electrical terminal has a terminal head and an electrical contact. The electrical contact extends from the terminal head and has a lengthwise axis and a spring finger contact. The spring finger contact is movable relative to the terminal head and has a cantilever portion and a contact portion. The cantilever portion extends away from the terminal head and away from the lengthwise axis of the electrical contact. The contact portion extends from the cantilever portion.

19 Claims, 11 Drawing Sheets

(56) References Cited

U.S. PATENT DOCUMENTS

| | | | | |
|---|---|---|---|---|
| 7,442,097 | B2 * | 10/2008 | Kumakura | H01R 43/16 439/879 |
| 7,520,767 | B2 * | 4/2009 | Tamagawa | H01R 13/6658 439/189 |
| 9,300,085 | B2 | 3/2016 | Morello et al. | |
| 9,331,408 | B2 * | 5/2016 | Ono | H01R 13/20 |
| 9,531,104 | B1 * | 12/2016 | Park | H01R 13/4361 |
| 9,847,591 | B2 * | 12/2017 | Glick | H01R 13/18 |
| 9,871,313 | B2 | 1/2018 | Saito et al. | |
| 10,122,108 | B2 * | 11/2018 | Bhagyanathan Sathianathan | H01R 13/187 |
| 10,181,661 | B2 * | 1/2019 | Manba | H01R 12/774 |
| 10,193,258 | B2 * | 1/2019 | Balser | H01R 13/18 |
| 10,205,260 | B2 * | 2/2019 | Takemoto | H01R 12/79 |
| 10,276,959 | B2 * | 4/2019 | Lehner | H01R 13/187 |
| 11,289,841 | B2 * | 3/2022 | Ikegami | H01R 12/79 |
| 11,329,400 | B2 * | 5/2022 | Mezrioui | H01R 13/187 |
| 2006/0271136 | A1 | 11/2006 | Wojciechowicz | |

* cited by examiner

ELECTRICAL TERMINAL AND ELECTRICAL CONNECTOR ASSEMBLY FOR ELECTRICALLY CONDUCTIVE STRUCTURES

FIELD

The disclosure relates generally to the field of electrical terminals and electrical connector assemblies that facilitate electrical connections between two electrical conductive structures. More particularly, the disclosure relates to an electrical terminal and an electrical connector assembly for electrically conductive structures.

BACKGROUND

Conventionally, electrical systems can include one or more electrically operated devices that are each connected to a source of electrical energy and/or other components of an electrical system by one or more electrical conductors. For example, most automobiles and other vehicles include a variety of electrically operated devices that can be selectively operated for the comfort and convenience of a driver or an occupant. In many instances, electrical connector assemblies are provided on the electrical conductors to facilitate the installation, service, and removal of these electrically operated devices to and from the electrical system.

A typical electrical connector assembly includes an outer housing (which is usually formed from an electrically non-conductive material) and an inner electrical terminal (which is usually formed from an electrically conductive material) that is supported within the housing. The inner electrical terminal is used to electrically connect a first electrically conductive structure and a second electrically conductive structure. For example, engagement of the first electrically conductive structure, such as those taut include one or more electrical contacts (e.g., one or more electrically conductive pins), with the inner electrical terminal is accomplished by inserting a portion of the first electrically conductive structure into a passageway defined by the inner electrical terminal. Engagement with the second electrically conductive structure, such as flat flexible conductors that have multiple electrically conductive traces, with the inner electrical terminal is accomplished by crimping an end of the inner electrical terminal onto a portion of the second electrically conductive structure (e.g., an electrically conductive trace). Such crimping is accomplished using of a variety of specialized tools and/or specialized methods. Although effective, use of these specialized tools and methods can be relatively complex and time-consuming. Thus, it would be desirable to provide an improved structure for such an electrical terminal that can accomplish a quick and easy connection between two electrically conductive structures.

A need exists, therefore, for new and useful electrical terminal and electrical connector assemblies for electrically conductive structures.

SUMMARY

Various example electrical terminals and electrical connector assemblies for electrically conductive structures are described.

An example electrical terminal has a terminal head and an electrical contact. The electrical contact extends from the terminal head and has a lengthwise axis and a spring finger contact. The spring finger contact is movable relative to the term terminal head and has a cantilever portion and a contact portion. The cantilever portion extends away from the terminal head and away from the lengthwise axis of the electrical contact. The contact portion extends from the cantilever portion.

An example electrical connector assembly has an electrical connector housing and an electrical terminal. The electrical connector housing has a first end, a second end, a base, and a cover. The base has a passageway that extends from the first end of the electrical connector housing toward the second end of the electrical connector housing. The cover is movable between an open position and a closed position relative to the base. The electrical terminal has a terminal head and an electrical contact. The terminal head is disposed within the passageway of the electrical connector housing. The electrical contact extends from the terminal head and has a lengthwise axis and a spring finger contact. The spring finger contact is movable relative to the terminal head between a first position and a second position. The spring finger contact is in the first position when the cover is in the open position. The spring finger contact is in the second position when the cover is in the closed position. The spring finger contact has a cantilever portion and a contact portion. The cantilever portion extends away from the terminal head and away from the lengthwise axis of the electrical contact. The contact portion extends from the cantilever portion.

Another example electrical connector assembly has an electrical connector housing, an electrical terminal, and a flat flexible connector. The electrical connector housing has a first end, a second end, a base, and a cover. The base has a passageway that extends from the first end of the electrical connector housing toward the second end of the electrical connector housing. The cover is movable between an open position and a closed position relative to the base. The electrical terminal has a terminal head and an electrical contact. The terminal head is disposed within the passageway of the electrical connector housing. The electrical contact extends from the terminal head and has a lengthwise axis, a spring finger contact, and a support. The spring finger contact is movable relative to the terminal head between a first position and a second position. The spring finger contact is in the first position when the cover is in the open position. The spring finger contact is in the second position when the cover is in the closed position. The spring finger contact has a first surface, a second surface, a first end, a second end, a cantilever portion, a contact portion, and a tail portion. The second surface opposably faces the first surface. The cantilever portion extends away from the terminal head and away from the lengthwise axis of the electrical contact. The contact portion extends from the cantilever portion. The tail portion extends from the contact portion and contacts the support when in the spring finger contact is in the second position. The tail portion has a curved portion that extends from the contact portion to the second end of the spring finger contact. The flat flexible connector is disposed within the electrical connector housing between the base and the cover. The flat flexible connector has an electrically conductive trace contacting the contact portion when the cover is in the closed position. The first surface contacts the electrically conductive trace and the support when the spring finger contact is in the second position.

Additional understanding of these examples can be obtained by review of the detailed description, below, and the appended drawings.

DETAILED DESCRIPTION

The following detailed description and the appended drawings describe and illustrate various example embodiments of electrical terminals and electrical connector assemblies for electrically conductive structures. The description and illustration of these examples are provided to enable one skilled in the art to make and use an electrical terminal and an electrical connector assembly according to this invention. They are not intended to limit the scope of the claims in any manner.

Figure 4:
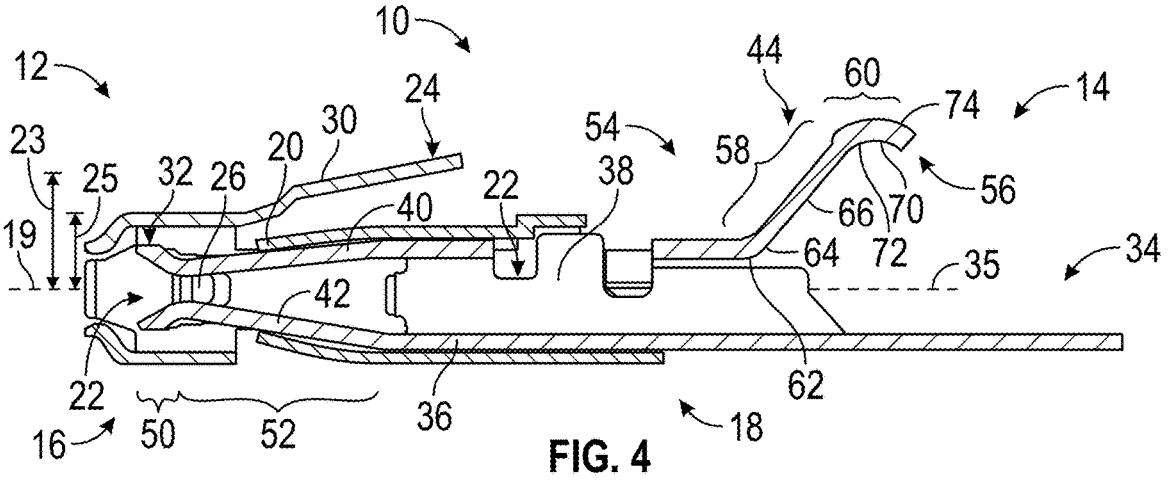
FIG. 4 is a side sectional view of the electrical terminal illustrated in FIG. 1 taken along the lengthwise axis of the terminal head.

FIGS. 1, 2, 3, and 4 illustrate a first embodiment of an electrical terminal 10 that has a terminal head 12 and an electrical contact 14. The terminal head 12 has a first end 16, a second end 18, a lengthwise axis 19, a main body 20 that defines a passageway 22, a retaining member 24, a first projection 26, and a second projection 28. The passageway 22 extends from the first end 16 to the second end 18 and is adapted to receive the electrical contact 14 and a portion of an electrically conductive structure (e.g., an electrically conductive pin of an electrically conductive structure). The retaining member 24 is adapted to accomplish attachment of the terminal head 12 to an electrical connector housing, as described herein. Any suitable retaining member can be included on a terminal head. In the illustrated embodiment, the retaining member 24 is a retaining projection 30 that extends from the main body 20 of the terminal head 12, away from the lengthwise axis 19, and toward the second end 18. The retaining projection 30 is movable between a first position, as shown in FIGS. 1 through 4, and a second position. The retaining projection 30 is disposed a first distance 23 from the lengthwise axis 19 in the first position, as shown in FIG. 4, and is disposed a second distance 25 from the lengthwise axis 19 in the second position. The second distance 25 is less than the first distance 23. The retaining projection 30 is biased to the first position such that attachment to an electrical connector housing can be achieved. Each of the first and second projections 26, 28 extends into the passageway 22 and is adapted to be disposed between the first and second retaining arms 40, 42 of the electrical contact 14, as described in more detail herein, to accomplish attachment of the electrical contact 11 to the terminal head 12. While projections 26, 28 have been illustrated as accomplishing attachment between an electrical contact and a terminal head, any other structure can be used to accomplish such attachment.

The electrical contact 14 extends from the terminal head 12 and has a first end 32, a second end 34, a lengthwise axis 35, and a main body 36 that defines a base 38, a first retaining arm 40, a second retaining arm 42, and a spring finger contact 44. Each of the first and second retaining arms 40, 42 extends from the base 38, to the first end 16 of the terminal head 12, and is disposed within the passageway 22 defined by the terminal head 12. Each of the first and second retaining arms 40, 42 has a first end 46 and a second end 48 attached to the base 38. As shown in FIG. 4, the first and second retaining arms 40, 42 cooperatively define a tapered region 50 and a flared region 52 between the first and second retaining arms 40, 42. The tapered region 50 extends from the first end 32 of the electrical contact 14 toward the second end 34 of the electrical contact 14. The tapered region 50 also extends from the first end 46 of each of the first and second retaining arms 40, 42 toward the second end 48 of each of the first and second retaining arms 40, 42. The flared region 52 extends from the tapered region 50 toward the second end 34 of the electrical contact 14. The flared region 52 also extends from the tapered region 50 toward the second end 48 of each of the first and second retaining arms 40, 42. As shown in FIG. 4, each of the first and second retaining arms 40, 42 is disposed between, and contacts, the main body 20 of the terminal head 12 and the first and second projections 26, 28 such that the first and second projections 26, 28 are disposed between the first and second retaining arms 40, 42 within the flared region 52.

Figure 1:
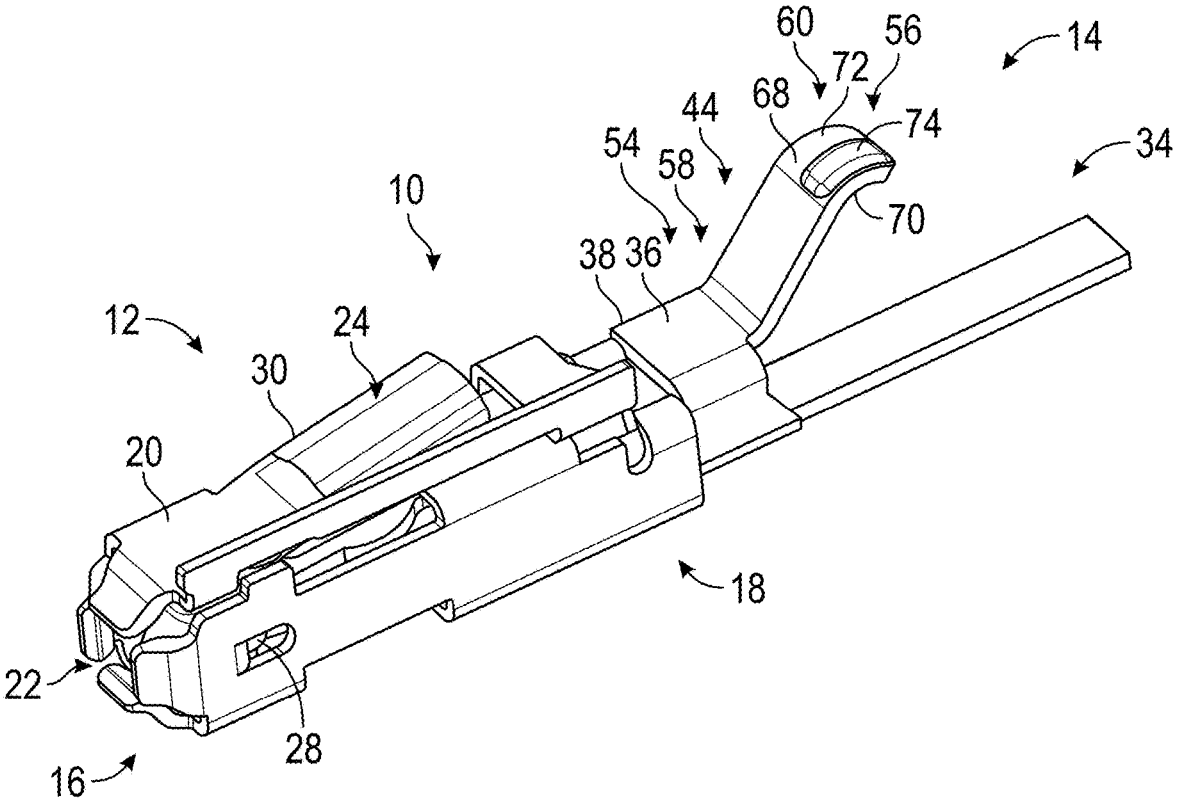
FIG. 1 is a perspective view of a first embodiment of an electrical terminal for electrically conductive structures.
Figure 2:
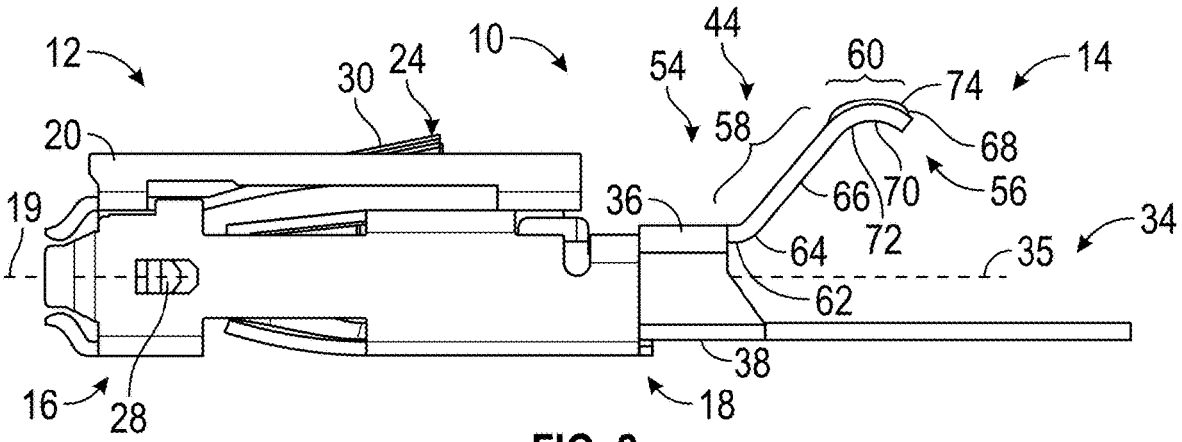
FIG. 2 is a side view of the electrical terminal illustrated in FIG. 1.
Figure 3:
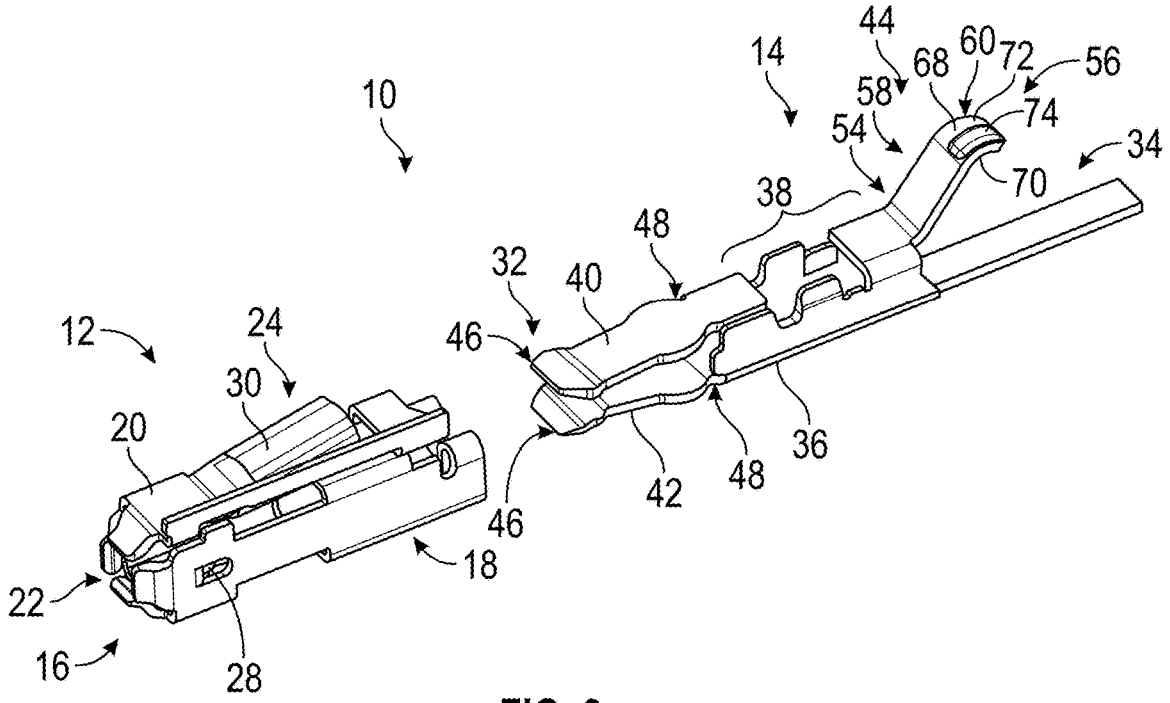
FIG. 3 is an exploded perspective view of the electrical terminal illustrated in FIG. 1.

The spring finger contact 44 is moveable relative to the terminal head 12 and the base 38 of the electrical contact 14 upon the application of an external force on the spring finger contact 44. The spring finger contact 44 has a first end 54, a second end 56, a cantilever portion 58, and a contact portion 60, The cantilever portion 58 extends from the base 38, away from the terminal head 12, away from the first end 32 of the electrical contact 14, and away from the lengthwise axis 35 of the electrical contact 14. In the illustrated embodiment, as shown in FIGS. 2 and 4, the cantilever portion 58 has a cantilever portion first, linear portion 62, a cantilever portion second, curved portion 64, and a cantilever portion third, linear portion 66. However, alternative embodiments can include a cantilever portion that has any suitable structural arrangement, such as those that omit the inclusion of a first, linear portion, a second, curved portion, or a third, linear portion. The cantilever portion first, linear portion 62 extends from the first end 54 of the spring finger contact 44, away from the terminal head 12, and to the cantilever portion second, curved portion 64. The cantilever portion second, curved portion 64 extends from the cantilever portion first, linear portion 62, away from the lengthwise axis 35 of the electrical contact 14, to the cantilever portion third, linear portion 66. The cantilever portion third, linear portion 66 extends from the cantilever portion second, curved portion 64, away from the lengthwise axis 35 of the electrical contact 14, and to the contact portion 60. The contact portion 60 extends from the cantilever portion 58, away from the terminal head 12, and away from the first, end 32 of the electrical contact 14. In the illustrated embodiment, as shown in FIGS. 2 and 4, the contact portion 60 has a first surface 68, a second surface 70, a contact portion first, curved portion 72, and a protuberance 74. The first surface 68 opposably faces the second surface 70. The contact portion first, curved portion 72 extends from the cantilever portion third, linear portion 66 to the second end 56 of the spring finger contact 44 and toward the lengthwise axis 35 of the electrical contact 14. The protuberance 74 extends from the first surface 68 and away from the second surface 70. While a protuberance has been shown as included on a contact portion of a spring finger contact, alternative embodiments can omit the inclusion of a protuberance.

While the terminal head 12 and electrical contact 14 have been illustrated as having a particular structural arrangement, a terminal head and an electrical contact included in an electrical terminal can have any suitable structural arrangement and be formed of any suitable material. Selection of a suitable structural arrangement and material to form a terminal head and/or an electrical contact can be based on various considerations, including the intended use of the electrical terminal. Examples of materials considered suitable to form a terminal head and/or an electrical contact include electrically conductive materials.

In the illustrated embodiment, the electrical contact 14 is a separate component that is attached to the terminal head 12. However, alternative embodiments can include a terminal head and an electrical contact that is formed from a single piece of material. When formed as two separate components, as shown in FIGS. 1, 2, 3, and 4, the first end 32 of the electrical contact 14 is aligned with the second end 18 and the passageway 22 defined by the terminal head 12. An axial force is applied to one or both of the terminal head 12 and the electrical contact 14 directed toward the other component or each other such that the first and second retaining arms 40, 42 are advanced into the passageway 22 defined by the terminal head 12 and the first and second projections 26, 28 of the terminal head 12 are advanced through the tapered region 50 and into the flared region 52 of the electrical contact 14. The position of the first and second projections 26, 28 relative to the main body 20 of the terminal head 12 forces each of the first and second retaining arms 40, 42 between the main body 20 and the first and second projections 26, 28 accomplishing attachment between the terminal head 12 and the electrical contact 14. While attachment between the terminal head 12 and the electrical contact 14 has been illustrated as being accomplished using the main body 30 of the terminal head 12 and the first and second projections 26, 28, any suitable structure and/or attachment member can be used to accomplish attachment between a terminal head and an electrical contact.

Figure 5:
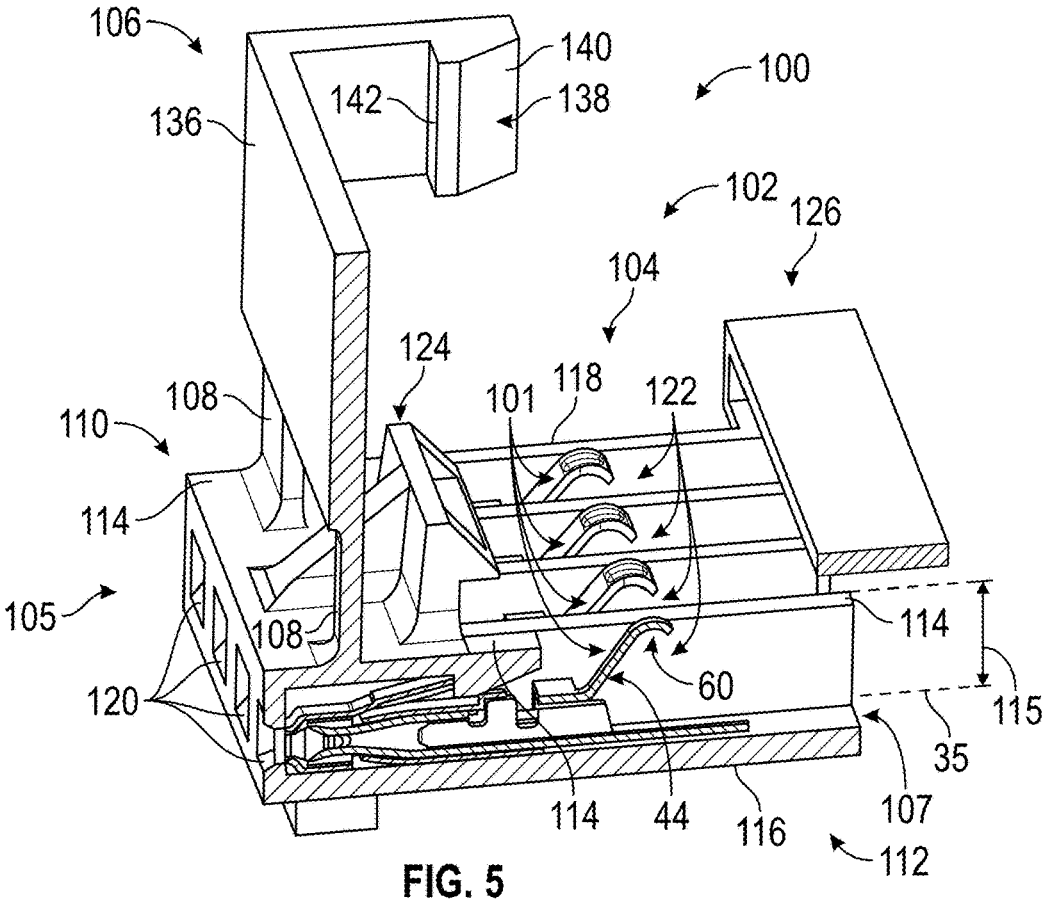
FIG. 5 is a perspective sectional view of a first embodiment of an electrical connector assembly for electrically conductive structures. The electrical connector assembly includes the electrical terminal illustrated in FIG. 1 and an electrical connector housing. The cover of the electrical connector housing is shown in an open position.
Figure 6:
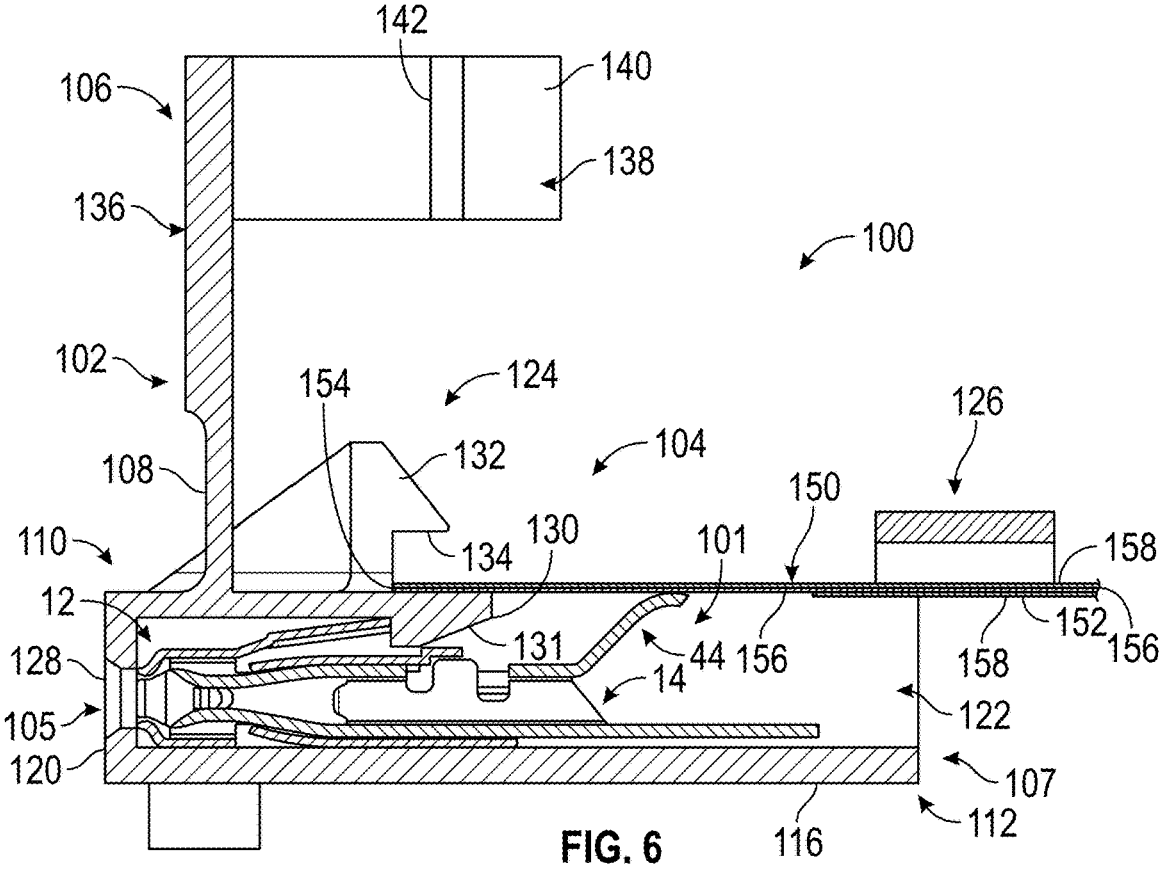
FIG. 6 is a side view of the electrical connector assembly illustrated in FIG. 5. An electrically conductive structure is partially disposed within the electrical connector housing and the cover of the electrical connector housing is shown in an open position.
Figure 7:
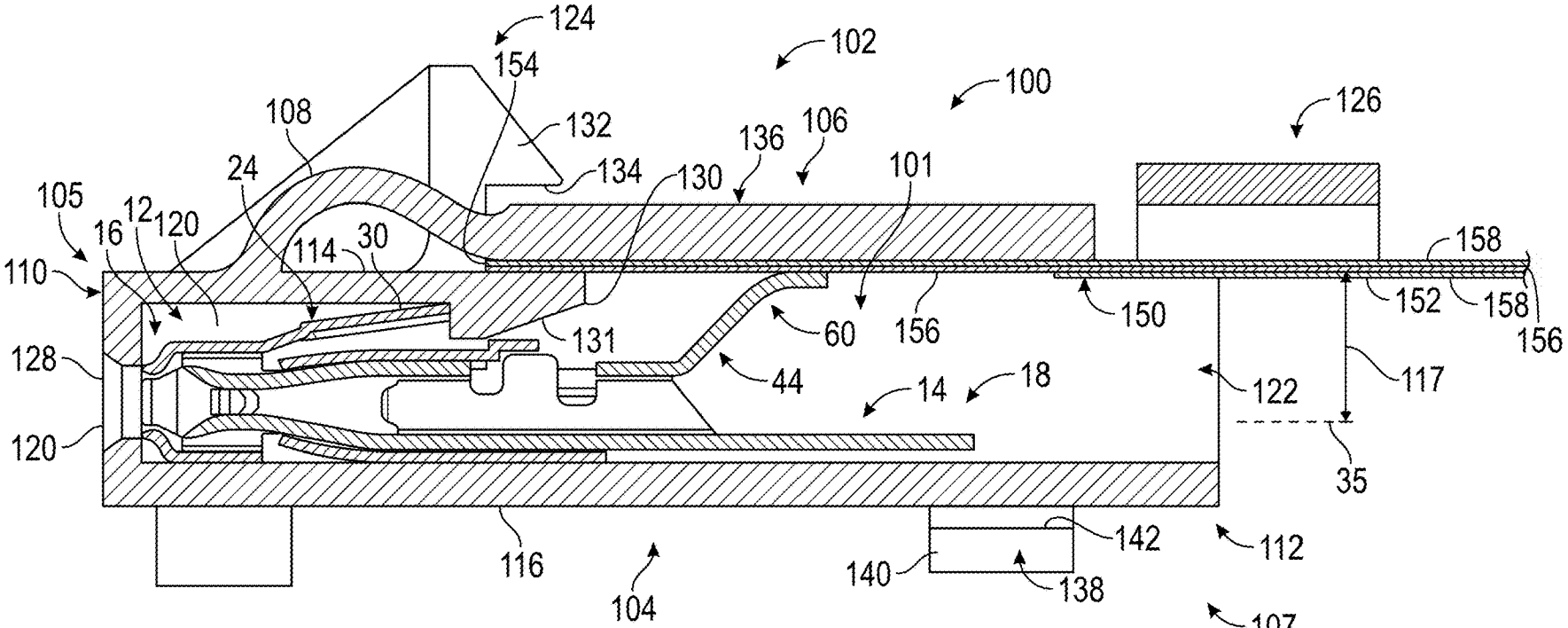
FIG. 7 is another side view of the electrical connector assembly illustrated in FIG. 5. An electrically conductive structure is partially disposed within the electrical connector housing and the cover of the electrical connector housing is shown in a closed position.

FIGS. 5, 6, and 7 illustrate a first embodiment of an electrical connector assembly 100 that includes a plurality of electrical terminals 101 housed within an electrical connector housing 102. The electrical connector housing 102 has a first end 105, a second end 107, a base 104 and a cover 106. The cover 106 is movable between an open position, as shown in FIGS. 5 and 6, and a closed position, as shown in FIG. 7, relative to the base 104. A cover included in an electrical connector housing 102 can be movable relative to a base rising any suitable structure. In the illustrated embodiment, the cover 106 is attached to the base 104, and pivotable relative to the base 104, using a plurality of living hinges 108. However, alternative embodiments can include a cover as a separate component that can be releasably attached to a base.

The base 104 has a first end 110, a second end 112, a top 114, a bottom 116, a first side 118, a plurality of passageways 120, a plurality of recesses 122, a locking member 124, and a retention arm 126. While the second side has not been illustrated in FIGS. 5, 6, and 7, FIG. 16 shows an example of a second side of a base of an electrical connector housing. Each passageway of the plurality of passageways 120 extends from the first end 105 of the electrical connector housing 102 toward the second end 107 of the electrical connector housing 102. Each passageway of the plurality of passageways 120 extends from a first opening 128 on the first end 110 of the base 104 to a second opening 130 that is in communication with a recess of the plurality of recesses 122. A retaining member projection 131 extends into each passageway of the plurality of passageways 120 and assists with attachment of an electrical terminal of the plurality of electrical terminals 101 to the base 104, as described herein. Each recess of the plurality of recesses 122 extends from the second end 112 of the base 104 toward the first end 110 of the base 104 and from the top 114 of the base 104 toward the bottom 116 of the base 104. However, alternative embodiments can include a recess that extends from a location between a second end of a base and a first end of the base toward the first end of the base. Each passageway of the plurality of passageways 120 is adapted to receive a portion of an electrical terminal of the plurality of electrical terminals 101 and each recess of the plurality of recesses 122 is adapted to receive a portion of the electrical terminal of the plurality of electrical terminals 101 such that a first portion of an electrical terminal of the plurality of electrical terminals 101 is disposed within a passageway of the plurality of passageways 120 and a second portion of the electrical terminal of the plurality of electrical terminals 101 is disposed within a recess of the plurality of recesses 122. The locking member 124 extends from the top 114 of the base 104 and away from the bottom 116 of the base 104 and defines a tapered projection 132 and a shoulder 134. The retention arm 126 extends over the top 114 of the base 104, over the plurality of recesses 122, and provides a mechanism for maintaining the position of an electrically conductive structure, as described in more detail herein, relative to the base 104.

While the base 104 has been illustrated as including a plurality of passageways 120 and a plurality of recesses 122 having a particular structural arrangement, a base of an electrical connector housing can include any suitable number of passageways and recesses having any suitable structural arrangement. Selection of a suitable structural arrangement for a passageway and a recess, and of a suitable number of passageways and recesses, to include in an electrical connector housing can be based on various considerations, such as the intended use of the electrical connector housing. Examples of numbers of passageways and recesses considered suitable to include in an electrical connector housing include one, more than one, two, a plurality, three, four, five, more than five, and any other number considered suitable for a particular embodiment. In the illustrated embodiment, the plurality of passageways 120 includes four passageways and the plurality of recesses 122 includes four recesses.

In the illustrated embodiment, the cover 106 is pivotably attached to the base 104 and has a main body 136 and a locking member 138. The main body 136 is adapted to be disposed between the locking member 124 of the base 104 and the top 114 of the base 104 and is adapted to clamp a portion of an electrically conductive structure between the main body 136 and the base 104 when the cover 106 is in the closed position. The locking member 138 extends from the main body 136 and beyond the bottom 116 of the base 104 when the cover 106 is in the closed position and defines a tapered projection 140 and a shoulder 142.

An electrical connector housing included in an electrical connector assembly can have any suitable structural arrangement and be formed of any suitable material and selection of a suitable structural arrangement and material to form an electrical connector housing can be based on various considerations, including the intended use of the electrical connector assembly. Examples of materials considered suitable to form an electrical connector housing include electrically non-conductive materials.

Each electrical terminal of the plurality of electrical terminals 101 is housed within, and attached to, the electrical connector housing 102. In the illustrated embodiment, each electrical terminal of the plurality of electrical terminals 101 is similar to the electrical terminal 10 illustrated in FIGS. 1, 2, 3, and 4. However, other electrical terminals, such as the alternative embodiments described herein, can be housed within an electrical connector housing. Each electrical terminal of the plurality of electrical terminals 101 is positioned within the electrical connector housing 102 such that the terminal head 12 is disposed within a passageway of the plurality of passageways 120 and the electrical contact 14 is disposed within a recess of the plurality of recesses 122. As shown in FIG. 5, the spring finger contact 44 is positioned such that it is partially disposed tin a recess of the plurality of recesses 122, partially extends beyond the boundaries of the recess of the plurality of recesses 122, and partially extends beyond the top 114 of the base 104 when in the first position. This structural arrangement allows the spring finger contact 44 to contact an electrically conductive structure, as described in more detail herein.

Any suitable number of electrical terminals can be included in an electrical connector housing and selection of a suitable number of electrical terminals to include in an electrical connector housing can be based oil various considerations, including the number of electrically conductive traces, such as those described below, that are included in an electrically conductive structure intended to be attached to the electrical connector housing. Examples of numbers of electrical terminals considered suitable to include in an electrical connector housing include one, more than one, two, a plurality, three, four, five, more than live, a number that is the same as the number of passageways defined by a base of an electrical connector housing, a number that is the same as the number of electrically conductive traces provided on an electrically conductive structure, and any other number considered suitable for a particular embodiment. In the illustrated embodiment, the plurality of electrical terminals 101 includes four electrical terminals.

To position an electrical terminal of the plurality of electrical terminals 101 within the electrical connector housing 102, the first end 16 of the terminal head 12 is aligned with the second opening 130 of a passageway of the plurality of passageways 120 defined by the base 104. An axial force is applied to one or both of the electrical terminal of the plurality of electrical terminals 101 and the electrical connector housing 102 directed toward the other component or each other such that the terminal head 12 is advanced into the passageway of the plurality of passageways 120 defined by the base 104 and the retaining member 24 of the terminal head 12 is disposed between the retaining member projection 131 and the first end 110 of the base 104. In the illustrated embodiment, the retaining projection 30 moves from the first position to the second position (e.g., deflects) as the terminal head 12 moves relative to the electrical connector housing 102 and into the passageway of the plurality of passageways 120. Subsequently, after the retaining projection 30 is advanced to a position in which it is disposed between the retaining member projection 131 and the rust end 110 of the base 104, the retaining projection 30 moves back to the first position as a result of its bias to the first position.

As shown in FIGS. 6 and 7, an electrically conductive structure 150 can be positioned between the base 104 and the cover 106 and attached (e.g., releasably) to the electrical connector housing 102. An electrically conductive structure included in an electrical connector assembly can have any suitable structural arrangement and be formed of any suitable material and selection of a suitable structural arrangement and material to form an electrically conductive structure can be based on various considerations, including the intended use of the electrical connector assembly of which the electrically conductive structure is a component. In the illustrated embodiment, the electrically conductive structure 150 is a flat flexible connector 152 that has an end 154 and one or more electrically conductive traces 156 that are surrounded by an outer electrically non-conductive insulator 158. As discussed above, most automobiles and other vehicles include a variety of electrically operated devices that can be selectively operated for the comfort and convenience of a driver or an occupant. Typically, each of these electrically operated devices is connected to a source of electrical energy and/or other components of the electrical system by one or more electrical conductors. The electrically conductive traces 156 of the electrically conductive structure 150 can be used for this purpose.

In the illustrated embodiment, the electrically conductive structure 150 includes four electrically conductive traces 156. However, an electrically conductive structure can include any suitable number of electrically conductive traces, such as a number of electrically conductive traces that is the same as the number of electrical terminals included in an electrical connector assembly. For a reason that will become apparent below, a portion of the electrically non-conductive insulator 158 is removed adjacent to, or near, the end 154 of the electrically conductive structure 150 so as to expose the electrically conductive traces 156.

In use, and while the cover 106 is in the open position, the electrically conductive structure 150 is positioned on the base 104 of the electrical connector housing 102 such that each of the electrically conductive traces 156 is disposed adjacent to a spring finger contact 44 of an electrical terminal of the plurality of electrical terminals 101. In the embodiment illustrated, the electrically conductive structure 150 is positioned on the base 104 such that the end 154 of the electrically conductive structure 150 contacts, or is adjacent the locking member 124 of the base 104. Subsequently, the cover 106 of the electrical connector housing 102 is moved from the open position to the closed position such that the main body 136 of the cover 106 advances over the tapered projection 132 of the locking member 124 of the base 104 and is positioned between the shoulder 134 defined by the locking member 124 and the top 114 of the base 104. In addition, when the cover 106 is moved from the open position to the closed position, the tapered portion 140 of the locking member 138 of the cover 106 advances over the base 104 such that the base is positioned between the shoulder 142 and the main body 136 of the cover 106. As shown in FIG. 7, when the cover 106 is in the closed position, the electrically conductive structure 150 is fiat, or planar, between the base 104 and the cover 106 and each of the electrically conductive traces 156 contacts the contact portion 60.

As described herein, the spring finger contact 44 is movable relative to the terminal head 12 and the base 38 of the electrical contact 14 upon the application of an external force on the spring finger contact 44. When the cover 106 is in the open position, as shown in FIG. 5, the spring member contact 44 is in a first position and extends beyond the top 114 of the base 104 such that the contact portion 60 is disposed a first distance 115 from the lengthwise axis 35 of the electrical contact 14. When the cover 106 is in the closed position, as shown in FIG. 7, the spring member contact is in a second position, is compressed by cover 106, and the contact portion 60 is disposed a second distance 117 from the lengthwise axis 35 of the electrical contact 14 that is less than the first distance 115. As a result of the spring finger contact 44 being biased to the first position, when the cover 106 is in the closed position, the spring finger contact 44 contacts and engages a trace of the electrically conductive traces 156 to accomplish an electrically conductive connection between the trace and the electrical contact 14. Subsequently, a second electrically conductive structure, such as those that include one or more electrical contacts (e.g., one or more electrically conductive pins), can be advanced into the passageway 22 of the terminal head 12 from the first end 16 of the terminal head 12 toward the second end 18 of the terminal head 12 until the second electrically conductive structure contacts a portion of the terminal head 12 and/or electrical contact 14 (e.g., first retaining arm 40 and/or second retaining arm 12) to accomplish an electrically conductive connection between the electrical terminal of the plurality of electrical terminals 101 and the second electrically conductive structure. When the cover 106 is moved from the closed position to the open position, and the electrically conductive structure 150 is withdrawn from the electrical connector housing 102, the spring finger contact 44 moves from its second position to its first position such that it is disposed beyond the top 114 of the base 104 and the contact portion 60 is disposed a first distance 115 from the lengthwise axis 35 of the electrical contact 14.

The illustration of any component, element, or feature as being disposed above, below, left of, or right of another component, element, or feature is only with reference to the relative location of the components, elements, and features as shown in the figures in order to aid in describing the electrical terminals and electrical connector assemblies. Accordingly, the components, elements, or features illustrated and described herein can be oriented in any manner desired without departing from the spirit or scope of the invention.

Figure 8:
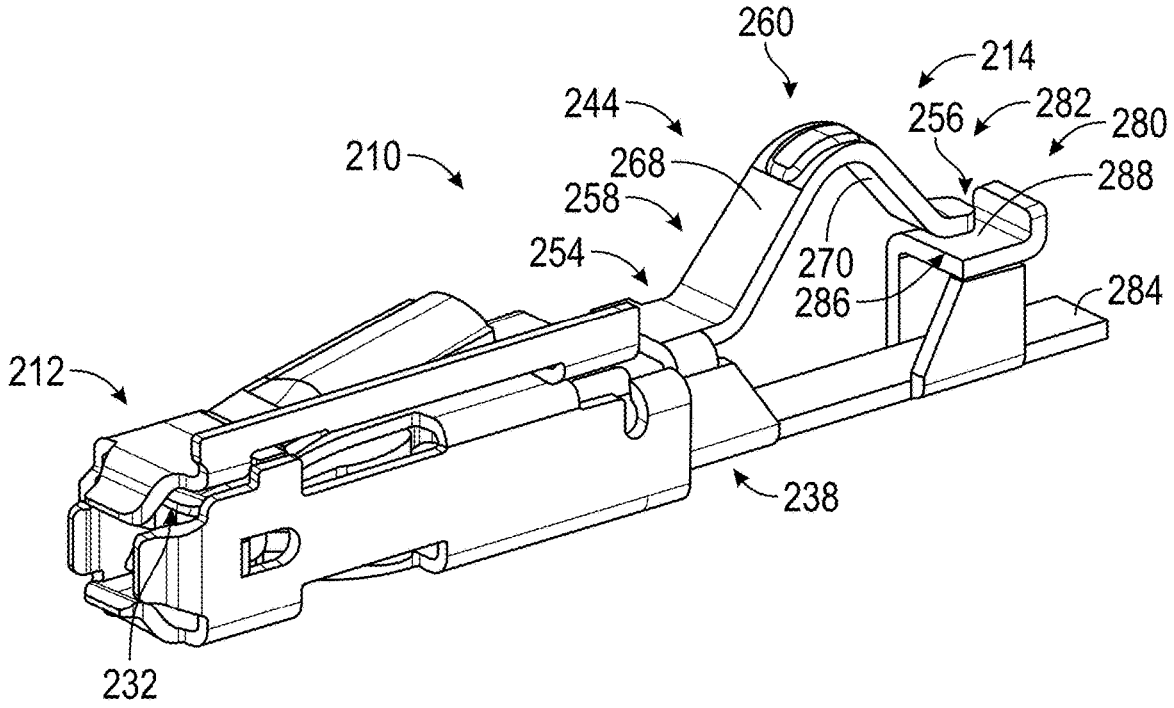
FIG. 8 is a perspective view of a second embodiment of an electrical terminal for electrically conductive structures.
Figure 9:
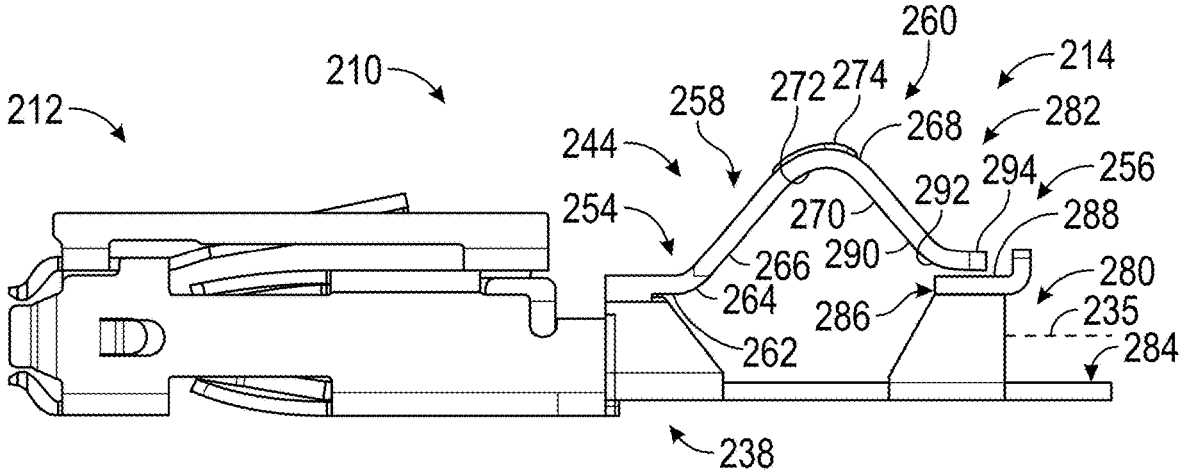
FIG. 9 is a side view of the electrical terminal illustrated in FIG. 8.

FIGS. 8 and 9 illustrate a second embodiment of an electrical terminal 210 that has a terminal head 212 and an electrical contact 214. In the illustrated embodiment, the electrical contact 214 has a support 280 and the spring finger contact 244 has a tail portion 282 that extends from the contact portion 260. The tail portion 282 contacts the support 280 when time spring finger contact 244 is in the second position, as described in more detail below.

The support 280 has an elongate member 284, a platform 286, and contact surface 288. The elongate member 284 extends from the base 238 of the electrical contact 214 and away from the first end 232 of the electrical contact 214. The platform 286 extends from the elongate member 284 and toward the spring finger contact 244. The contact surface 288 is defined on the platform 286 and is adapted to receive a portion of the spring finger contact 244 (e.g., the tail portion 282).

In the illustrated embodiment, the spring finger contact 244, has a first end 254, a second end 256, a cantilever portion 258, a contact portion 260, a first surface 268, a second surface 270, and a tail portion 282. The first surface 268 opposably faces the second surface 270.

The cantilever portion 258 extends from the base 238, away from the teiminal head 212, away from the first end 232 of the electrical contact 214, and away from the lengthwise axis 235 of the electrical contact 214. In the illustrated embodiment, the cantilever portion 258 has a cantilever portion first, linear portion 262, a cantilever portion second, curved portion 264, and a cantilever portion third, linear portion 266. The cantilever portion first, linear portion 262 extends from the first end 254 of the spring finger contact 244, away from the base 238, and to the cantilever portion second, curved portion 264. The cantilever portion second, curved portion 264 extends from the cantilever portion first, linear portion 262, away from the lengthwise axis 235 of the electrical contact 214, and to the cantilever portion third, linear portion 266. The cantilever portion third, linear portion 266 extends from the cantilever portion second, curved portion 264, away from the lengthwise axis 235 of the electrical contact 214, and to the contact portion 260. The contact portion 260 extends from the cantilever portion 258 and away from the terminal head 212. In the illustrated embodiment, the contact portion 260 has a contact portion first, curved portion 272 and a protuberance 274. The contact portion first, curved portion 272 extends from the cantilever portion third, linear portion 266 toward the lengthwise axis 235 of the electrical contact 214 to the tail portion 282 of the spring finger contact 244. The protuberance 274 extends from the first surface 268 and away from the second surface 270.

The tail portion 282 extends from the contact portion 260, toward the lengthwise axis 235 of the electrical contact 214, and toward the support 280 (e.g., the platform 286) to the second end 256. In the illustrated embodiment, the tail portion 282 has a tail portion first, linear portion 290, a tail portion second, curved portion 292, and a tail portion third, linear portion 294. The tail portion first, linear portion 290 extends from the contact portion first, curved portion 272 of the contact portion 260, away from the terminal head 212, toward the lengthwise axis 235 of the electrical contact 214, and toward the support 280 (e.g., the platform 286) to the tail portion second, curved portion 292, The tail portion second. curved portion 292 extends from the tail portion first, linear portion 290, toward the lengthwise axis 235 of the electrical contact 214, and to the tail portion third, linear portion 294. The tail portion third, linear portion 294 extends from the tail portion second, curved portion 292, away from the terminal head 212, toward the lengthwise axis 235 of the electrical contact 214, and toward the support 280 (e.g., the platform 286) to the second end 256. In the embodiment illustrated, the spring finger contact 244 is free of contact with the support 28( )(e.g., platform 286) when the spring finger contact 244 is in the first position, as shown in FIG. 9, and the spring finger contact 244 contacts the support 280 (e.g., platform 286) when the spring finger contact 244 is in the second position, as shown in FIG. 11, as described in more detail below.

However, alternative embodiments can include a spring finger contact that contacts a support (e.g., a platform) when in the first position and the second position.

Figure 11:
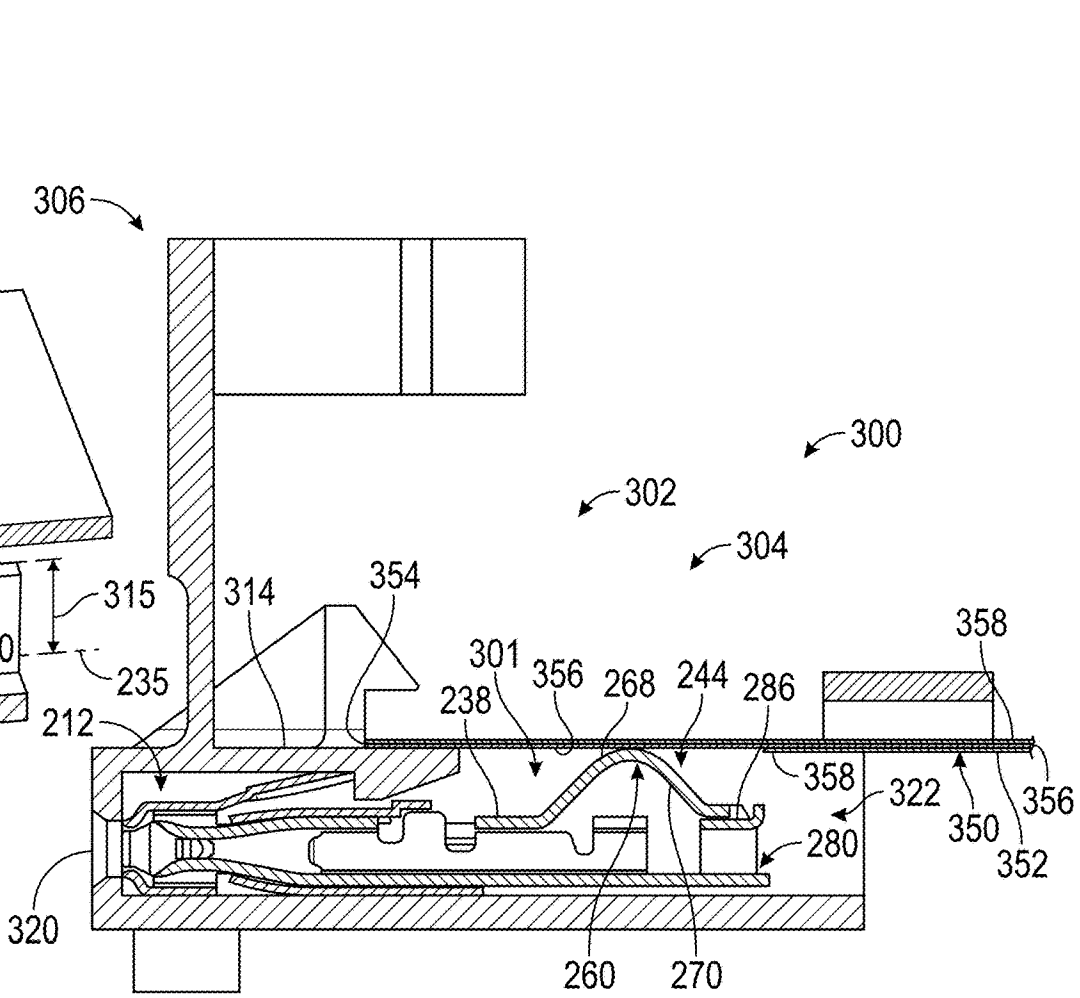
FIG. 11 is a side view of the electrical connector assembly illustrated in FIG. 10. An electrically conductive structure is partially disposed within the electrical connector housing and the cover of the electrical connector housing is shown in an open position.
Figure 10:
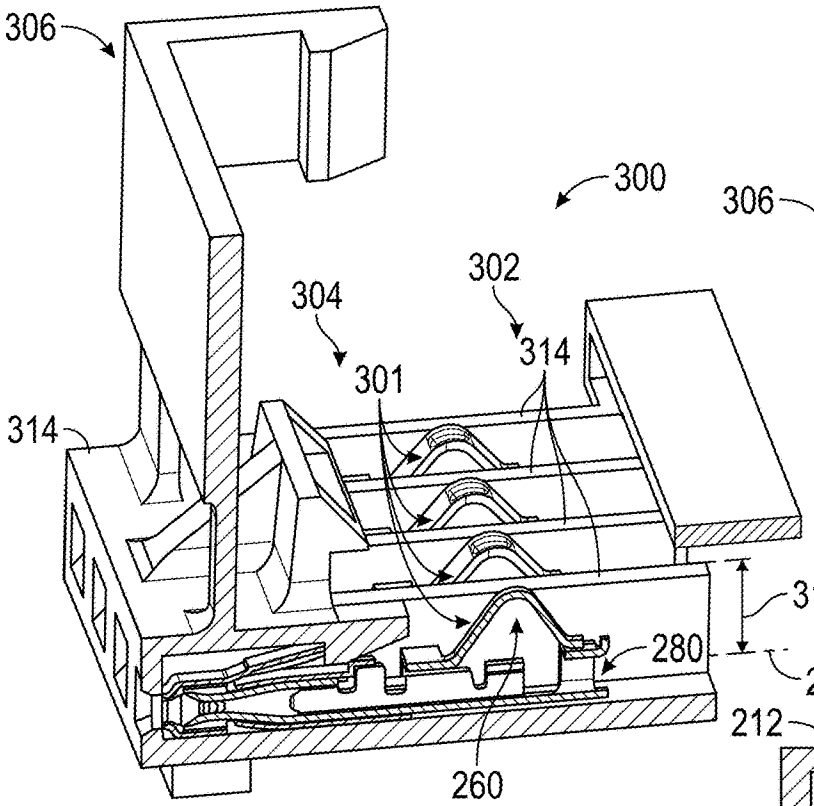
FIG. 10 is a perspective sectional view of a second embodiment of an electrical connector assembly for electrically conductive structures. The electrical connector assembly includes the electrical terminal illustrated in FIG. 8 and an electrical connector housing. The cover of the electrical connector housing is shown in an open position.
Figure 12:
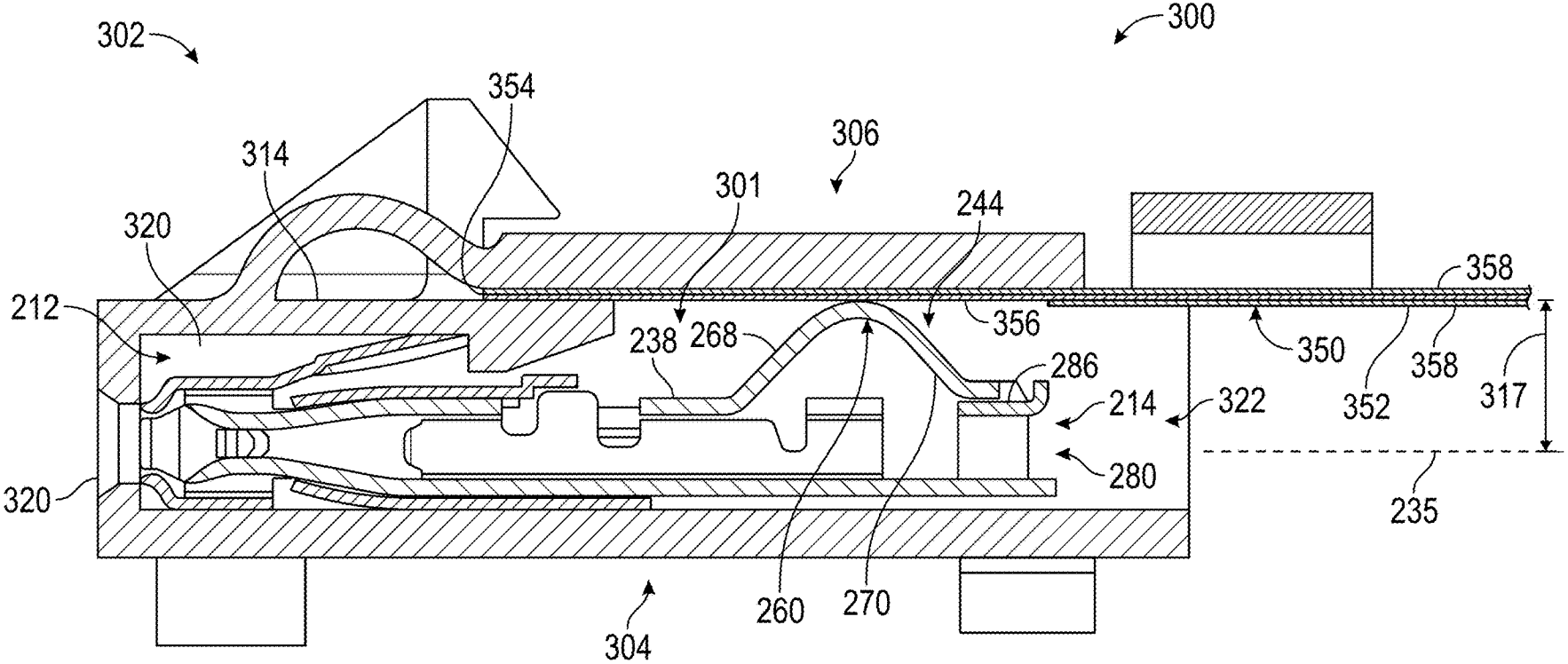
FIG. 12 is another side view of the electrical connector assembly illustrated in FIG. 10. An electrically conductive structure is partially disposed within the electrical connector housing and the cover of the electrical connector housing is shown in a closed position.

FIGS. 10 through 12 illustrate a second embodiment of an electrical connector assembly 300 that includes a plurality of electrical terminals 301 housed within an electrical connector housing 302. The electrical connector housing 302 is similar to the electrical connector housing 102 illustrated in FIGS. 5 through 7 and has a base 304 and a cover 306. The cover 306 is movable between an open position, as shown in FIGS. 10 and 11, and a dosed position, as shown in FIG. 12.

Each electrical term gal of the plurality of electrical terminals 301 is housed within, and attached to, the electrical connector housing 302. In the illustrated embodiment, each electrical terminal of the plurality of electrical terminals 301 is similar to the electrical terminal 210 illustrated in FIGS. 8 and 9. Each electrical terminal of the plurality of electrical terminals 301 is positioned within the electrical connector housing 302 such that the terminal head 212 is disposed within a passageway of the plurality of passageways 320 and the electrical contact 214 is disposed within a recess of the plurality of recesses 322. As shown in FIG. 10, the spring finger contact 244 is positioned such that it is partially disposed within a recess of the plurality of recesses 322, partially extends beyond the boundaries of the recess of the plurality of recesses 322, and partially extends beyond the top 314 of the base 304 when in the first position. This structural arrangement allows the spring finger contact 244 to contact an electrically conductive structure, as described in more detail herein.

As shown in FIGS. 11 and 12, an electrically conductive structure 350 can be positioned between the base 304 and the cover 306 and attached (e.g., releasably) to the electrical connector housing 302. In the illustrated embodiment, the electrically conductive structure 350 is a flat flexible connector 352 that has an end 354 and one or more electrically conductive traces 356 that are surrounded by an outer electrically non-conductive insulator 358. A portion of the electrically non-conductive insulator 358 is removed adjacent to, or near, the end 354 of the electrically conductive structure 350 so as to expose the electrically conductive traces 356.

In use, and while the cover 306 is in the open position, the electrically conductive structure 350 is positioned on the base 304 of the electrical connector housing 302 such that each of the electrically conch traces 356 is disposed adjacent to a spring finger contact 244 of an electrical terminal of the plurality of electrical terminals 301. Subsequently, the cover 306 of the electrical connector housing 302 is moved from the open position to the closed position. As described herein, the spring finger contact 244 is movable relative to the terminal head 212 and the base 238 of the electrical contact 214, upon the application of an external force on the spring finger contact 244. When the cover 306 is in the open position, as shown in FIG. 10, the spring member contact 244 is in a first position and extends beyond the top 314 of the base 304 such that the contact portion 260 is disposed a first distance 315 from the lengthwise axis 235 of the electrical contact 214. When the cover 306 is in the closed position, as shown in FIG. 12, the spring member contact 244 is in a second position, is compressed by the cover 306, and the contact portion 260 is disposed a second distance 317 from the lengthwise axis 235 of the electrical contact 21,4 that is less than the first distance 315. As a result of the spring finger contact 244 being biased to the first position, when the cover 306 is in the closed position, the spring finger contact 244 contacts and engages a trace of the electrically conductive traces 356 to accomplish an electrically conductive connection between the trace and the electrical contact 214. As shown in FIG. 12, when the cover 306 is in the closed position, the first surface 268 of the spring finger contact 244 contacts the electrically conductive trace 356 of the electrically conductive structure 350 and the second surface 270 contacts the support 280 (e.g., platform 286). When the cover 306 is moved from the closed position to the open position, and the electrically conductive structure 350 is withdrawn from the electrical connector housing 302, the spring finger contact 244 moves from its second position to its first position such that it is disposed beyond the top 314 of the base 304 and the contact portion 260 is disposed a first distance 315 from the lengthwise axis 235 of the electrical contact 214.

Figure 13:
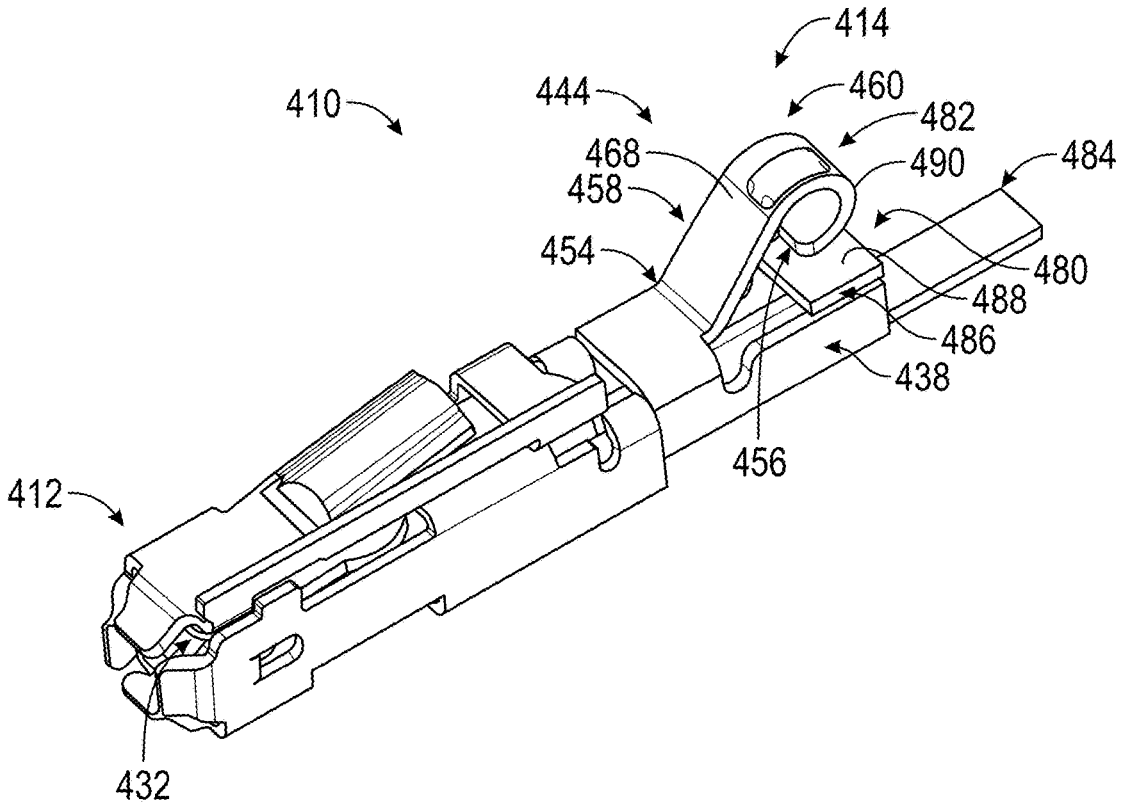
FIG. 13 is a perspective view of a third embodiment of an electrical terminal for electrically conductive structures.
Figure 14:
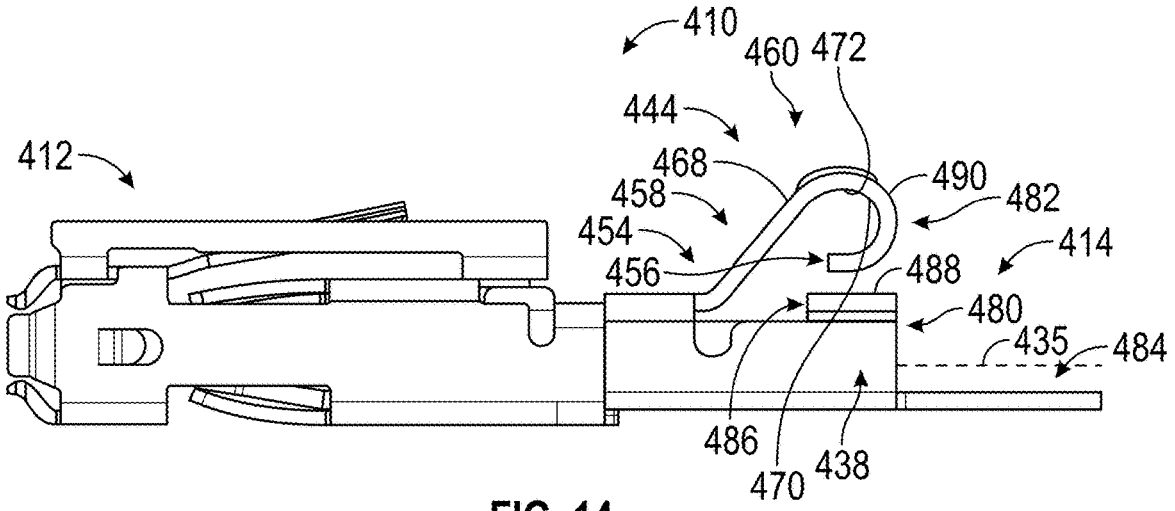
FIG. 14 is a side view of the electrical terminal illustrated in FIG. 13.

FIGS. 13 and 14 illustrate a third embodiment of an electrical terminal 410 that has a terminal head 412 and an electrical contact 414. In the illustrated embodiment, the electrical contact 414 has a support 480 and the spring finger contact 444 has a tail portion 482 that extends from the contact portion 460. The tail portion 482 contacts the support 480 when the spring finger contact 444 is in the second position, as described in more detail below.

The support 480 has an elongate member 484, a platform 486, and contact surface 488. The elongate member 484 extends from the base 438 of the electrical contact 414 and away from the first end 432 of the electrical contact 414. The platform 486 extends from the elongate member 484 and toward the spring finger contact 444. The contact surface 488 is defined on the platform 486 and is adapted to receive a portion of the spring finger contact 444 (e.g., the tail portion 482).

In the illustrated embodiment, the spring finger contact 444 has a first end 154, a second end 456, a cantilever portion 458, a contact portion 460, a first surface 468, a second surface 470, and a tail portion 482. The first surface 468 opposably faces the second surface 470. The cantilever portion 458 is similar to the cantilever portion 258 and the contact portion 460 is similar to the contact portion 260, as described herein.

The tail portion 482 extends from the contact portion 460, toward the lengthwise axis 435 of the electrical contact 414, and toward the support 480 (e.g., the platform 486) to the second end 456. in the illustrated embodiment, the tail portion 482 has a tail portion first, curved portion 490. The tail portion first, curved portion 490 extends from the contact portion first, curved portion 472 of the contact portion 460, toward the lengthwise axis 435 of the electrical contact 414, toward the cantilever portion 458, and to the second end 456. In the embodiment illustrated, the spring finger contact 444 is free of contact with the support 480 (e.g., platform 486) when the spring finger contact 444 is in the first position, as shown in FIG. 14, and the spring finger contact 444 contacts the support 480 (e.g., platform 486) when the spring finger contact 444 is in the second position, as shown in FIG. 18, as described in more detail herein.

Figure 15:
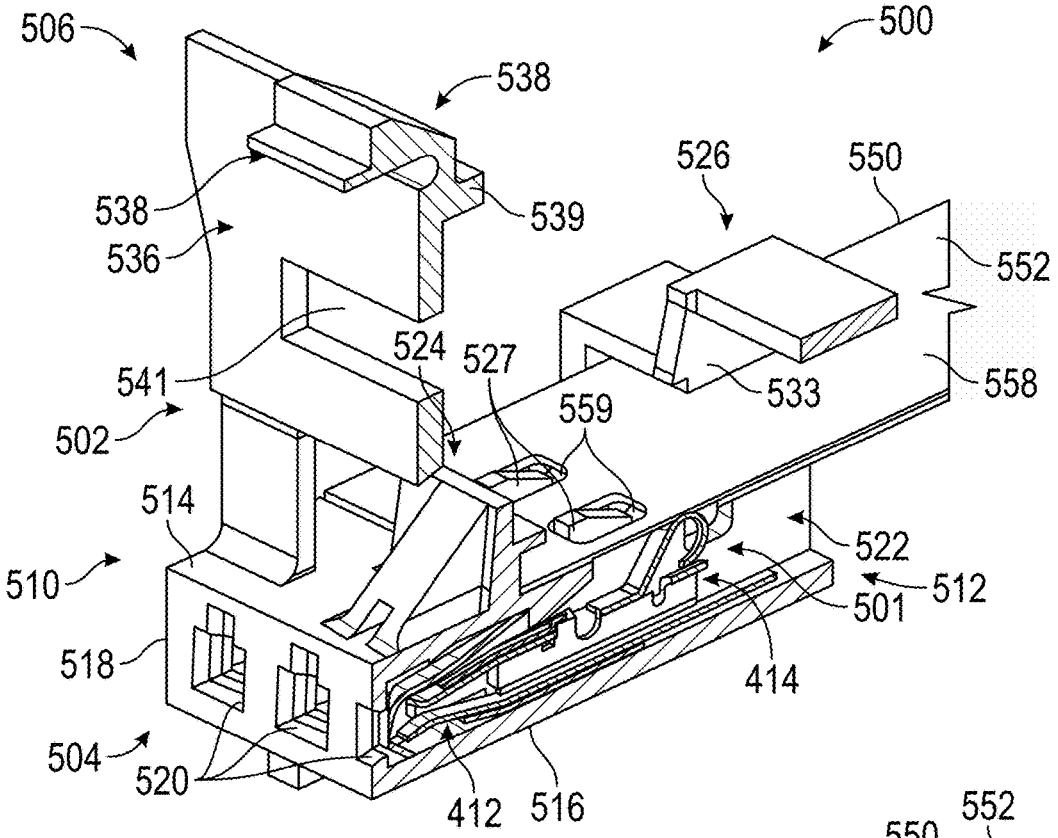
FIG. 15 is a perspective sectional view of a third embodiment of an electrical connector assembly for electrically conductive structures. The electrical connector assembly includes the electrical terminal illustrated in FIG. 13 and an electrical connector housing. An electrically conductive structure is partially disposed within the electrical connector housing and the cover of the electrical connector housing is shown in an open position.
Figure 16:
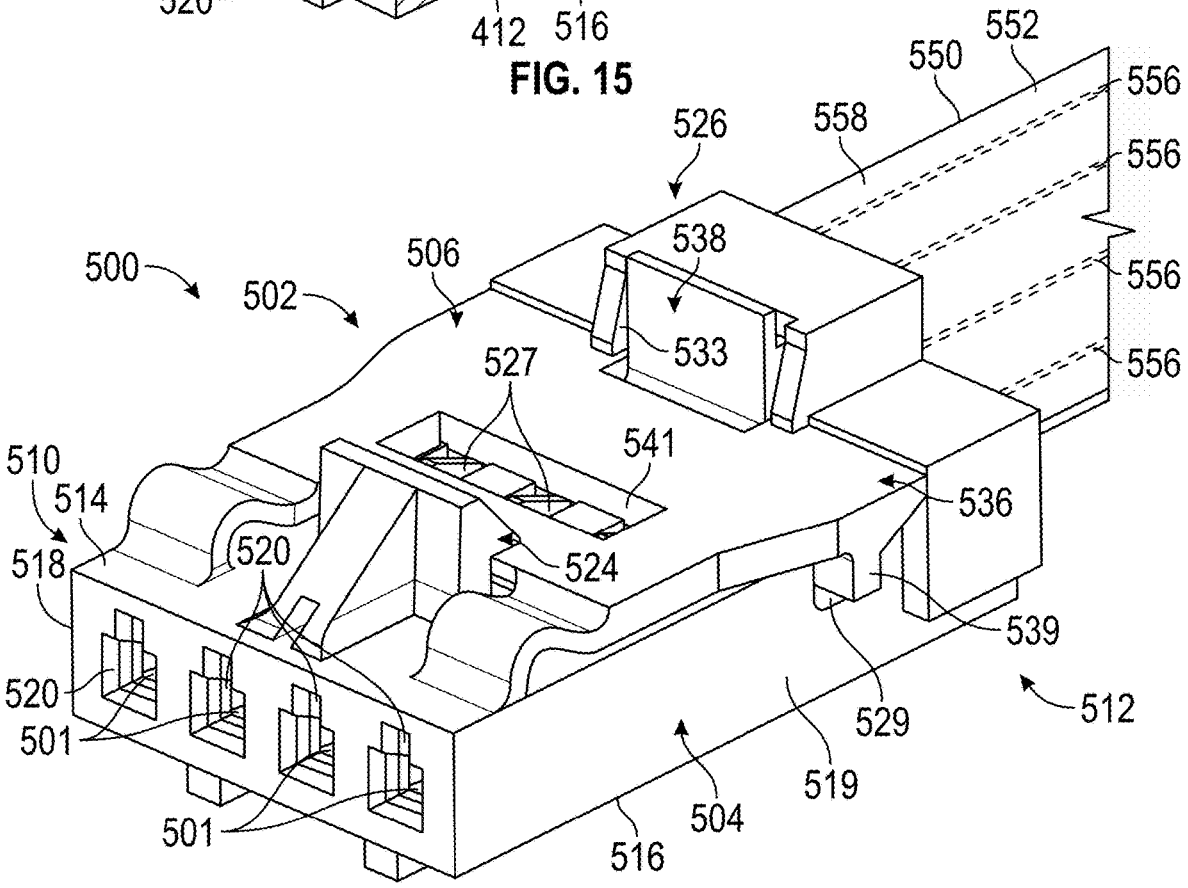
FIG. 16 is a perspective view of the electrical connector assembly illustrated in FIG. 15. An electrically conductive structure is partially disposed within the electrical connector housing and the cover of the electrical connector housing is shown in a closed position.
Figure 17:
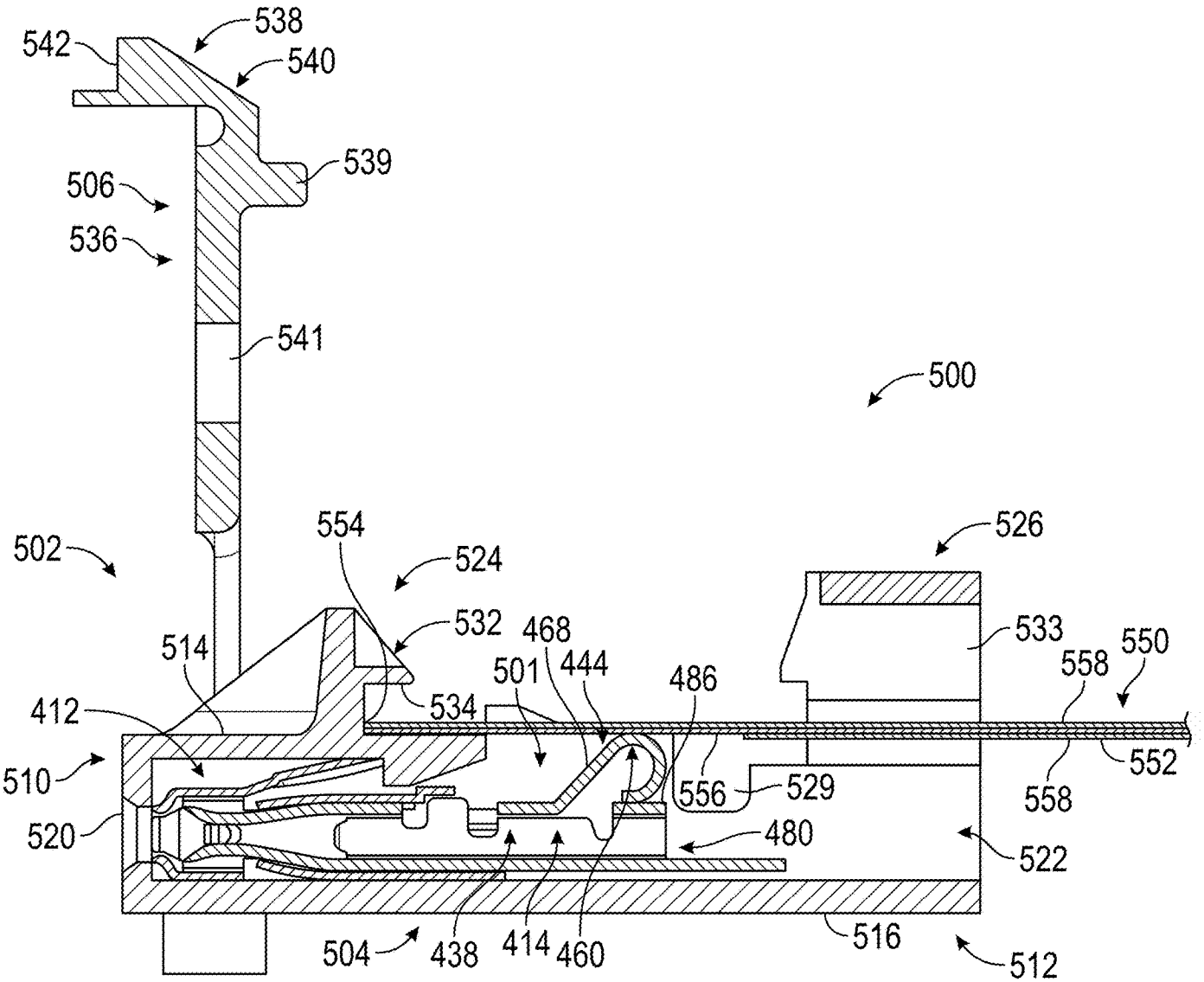
FIG. 17 is a side view of the electrical connector assembly illustrated in FIG. 15. An electrically conductive structure is partially disposed within the electrical connector housing and the cover of the electrical connector housing is shown in an open position.
Figure 18:
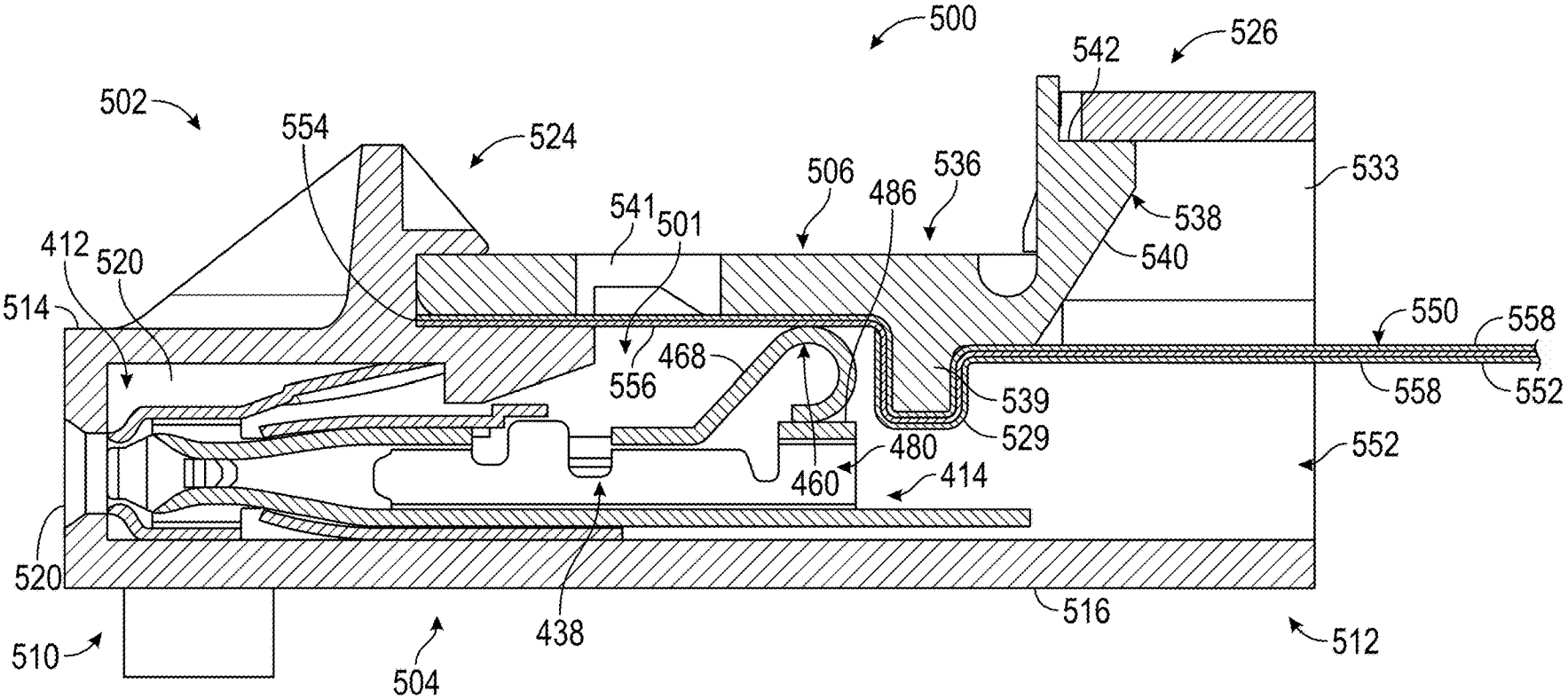
FIG. 18 is a side view of the electrical connector assembly illustrated in FIG. 15. An electrically conductive structure is partially disposed within the electrical connector housing and the cover of the electrical connector housing is shown in a closed position.

FIGS. 15 through 18 illustrate a third embodiment of an electrical connector assembly 500 that includes a plurality of electrical terminals 501 housed within an electrical connector housing 502. The electrical connector housing 502 is similar to the electrical connector housing 102 illustrated in FIGS. 5 through 7, except as detailed below, and has a base 504 and a cover 506. The cover 506 is movable between an open position, as shown in FIGS. 15 and 17, and a closed position, as shown in FIGS. 16 and 18.

Each electrical terminal of the plurality of electrical terminals 501 is housed within, and attached to, the electrical connector housing 502. In the illustrated embodiment, each electrical terminal of the plurality of electrical terminals 501 is similar to the electrical terminal 410 illustrated in FIGS. 13 and 14. Each electrical terminal of the plurality of electrical terminals 501 is positioned within the electrical connector housing 502 such that the terminal head 412 is disposed within a passageway of the plurality of passageways 520 and the electrical contact 414 is disposed within a recess of the plurality of recesses 522.

In the illustrated embodiment, the base 504 has a first end 510, a second end 512, a top 514, a bottom 516, a first side 518, a second side 519, a plurality of passageways 520, a plurality of recesses 522, a locking member 524, a retention arm 526, a plurality of projections 527, and a cover recess 529. Each passageway of the plurality of passageways 520 is adapted to receive a portion of an electrical terminal of the plurality of electrical terminals 501 and each recess of the plurality of recesses 522 is adapted to receive a portion of an electrical terminal of the plurality of electrical terminals 501 such that a first portion of an electrical terminal of the plurality of electrical terminals 501 is disposed within a passageway of the plurality of passageways 520 and a second portion of the electrical terminal of the plurality of electrical terminals 501 is disposed within a recess of the plurality of recesses 522. The retention arm 526 extends over the top 514 of the base 504 and over the plurality of recesses 522 and provides a mechanism for maintaining the position of an electrically conductive structure, as described in more detail herein, relative to the base 504. The retention arm 526 defines a recess 533 that is adapted to receive a portion of the locking member 538 of the cover 508. Each projection of the plurality of projections 527 extends from the top 514 of the base 504, away from the bottom 516 of the base 504, and is adapted to be received by an opening of the plurality of openings 559 defined by the electrically conductive structure 550, as described in more detail herein, such that the position of the electrically conductive structure 550 can be maintained relative to the electrical connector housing 502 during use. The cover recess 529 extends from the top 514 of the base 504 toward the bottom 516 of the base 504 and from the first side 518 to the second side 519. The cover recess 529 is disposed between the locking member 524 and the second end 512 of the base 504. The cover recess 529 is adapted to receive a portion of the electrically conductive structure 550 and a portion of the cover 506, as described herein.

In the illustrated embodiment, the cover 506 is pivotably attached to the base 504 and has a main body 536, a locking member 538, a projection 539 and a passageway 541, main body 536 is adapted to be disposed between the locking member 524 of the base 504 and the top 514 of the base 504 and is adapted to clamp a portion of the electrically conductive structure 550 between the cover 506 and the base 504 when the cover 506 is in the closed position. The locking member 538 extends from the main body 536 and away from the base 504 when the cover 506 is in the closed position and defines a tapered projection 540 and a shoulder 542. The projection 539 extends from the main body 536 and into the cover recess 529 when the cover 506 is in the closed position. The passageway 541 extends through the main body 336 and is adapted to receive each projection of the plurality of projections 527 defined by the base 504.

As shown in FIGS. 13 through 18, an electrically conductive structure 550 can be positioned between the base 504 and the cover 506 and attached (e.g., releasably) to the electrical connector housing 502. In the illustrated embodiment, the electrically conductive structure 550 is a flat flexible connector 552 that has an end 554, one or more electrically conductive traces 556 that are surrounded by an outer electrically non-conductive insulator 558, and a plurality of openings 559. A portion of the electrically non-conductive insulator 558 is removed adjacent to, or near, the end 554 of the electrically conductive structure 550 so as to expose the electrically conductive traces 556.

In use, and while the cover 506 is in the open position, the electrically conductive structure 550 is positioned on the base 504 of the electrical connector housing 502 such that each projection of the plurality of projections 527 defined by the base 504 is disposed within an opening of the plurality of openings 559 of the electrically conductive structure 550 and such that each of the electrically conductive traces 556 is disposed adjacent to a spring finger contact 444 of an electrical terminal of the plurality of electrical terminals 501. Subsequently, the cover 506 of the electrical connector housing 502 is moved from the open position to the closed position such that the main body 536 of the cover 506 advances over the tapered projection 532 of the locking member 524 of the base 504 and is positioned between the shoulder 534 defined by the locking member 524 and the top 514 of the base 504. In addition, when the cover 506 is moved from the open position to the closed position, the locking member 538 of the cover 506 is advanced over the retention arm 526 such that the retention arm 526 advances over the tapered portion 540 of the locking member 538 of the cover 506 and is positioned within the shoulder 542. As shown in FIG. 18, when the cover 506 is in the closed position, the electrically conductive structure 550 is disposed within the cover recess 529 and defines a plurality of curves between the base 504 and the cover 506.

As described herein, the spring finger contact 444 is movable relative to the terminal head 412 and the base 438 upon the application of an external force on the spring finger contact 444. When the cover 506 is in the closed position, as shown in FIGS. 16 and 18, the spring member contact 444 is in a second position and is compressed by the cover 506. As a result of the spring finger contact 444 being biased to the first position, when the cover 506 is in the closed position, the spring finger contact 444 (e.g., contact portion 460) contacts and engages a trace of the electrically conductive traces 556 to accomplish an electrically conductive connection between the trace and the electrical contact 414. As shown in FIG. 18, when the cover 506 is in the closed position, the first surface 468 of the spring finger contact 444 contacts the electrically conductive trace 556 of the electrically conductive structure 550 and the first surface 468 contacts the support 480 (e.g., platform 486).

Use of the electrical terminals and electrical connector assemblies described herein provide a mechanism for attaching an electrically conductive structure to an electrical terminal without requiring any crimped connection between the electrical terminal and the electrically conductive structure, which decreases the time and complexity required to make a connection between an electrical terminal and an electrically conductive structure.

Those with ordinary skill in the art will appreciate that various modifications and alternatives for the described and illustrated embodiments can be developed in light of the overall teachings of the disclosure, and that the various elements and features of one example described and illustrated herein can be combined with various elements and features of another example without departing from the scope of the invention. Accordingly, the particular examples disclosed herein have been selected by the inventor(s) simply to describe and illustrate examples of the invention and are not intended to limit the scope of the invention or its protection, which is to be given the full breadth of the appended claims and any and all equivalents thereof.

What is claimed is:

1. An electrical terminal comprising:

a terminal head and an electrical contact, the electrical contact extending from the terminal head and having a lengthwise axis and a spring finger contact, the spring finger contact moveable relative to the terminal head and having a cantilever portion and a contact portion, the cantilever portion extending away from the terminal head and away from the lengthwise axis of the electrical contact, the contact portion extending from the cantilever portion;

wherein the electrical contact has a support;

wherein the spring finger contact has a tail portion and is moveable relative to the terminal head between a first position and a second position, the tail portion extending from the contact portion and contacting the support when the spring finger contact is in the second position, wherein either:

the spring finger contact has a first surface and a second surface, the second surface opposably facing the first surface, the first surface adapted to contact an electrically conductive structure and contacting the support when the spring finger contact is in the second position; or the spring finger contact has a first end and a second end, and the tail portion has a tail portion first, linear portion, a tail portion second, curved portion, and a tail portion third, linear portion, the tail portion first, linear portion extending from the contact portion to the tail portion second, curved portion, the tail portion second, curved portion extending from the tail portion first, linear portion to the tail portion third, linear portion, the tail portion third, linear portion extending from the tail portion second, curved portion to the second end of the spring finger contact.

2. The electrical terminal of claim 1, wherein the contact portion is disposed a first distance from the lengthwise axis of the electrical contact in the first position and is disposed a second distance from the lengthwise axis of the electrical contact in the second position, the second distance being less than the first distance.

3. The electrical terminal of claim 1, wherein the spring finger contact has the first surface and the second surface, the first surface adapted to contact the electrically conductive structure, the second surface opposably facing the first surface and contacting the support when the spring finger contact is in the second position.

4. The electrical terminal of claim 1, wherein the spring finger contact has the first surface and the second surface, the second surface opposably facing the first surface, the first surface adapted to contact the electrically conductive structure and contacting the support when the spring finger contact is in the second position.

5. The electrical terminal of claim 1, wherein the electrical contact has a base; and wherein the cantilever portion has a cantilever portion first, linear portion, a cantilever portion second, curved portion, and a cantilever portion third, linear portion, the cantilever portion first, linear portion extending from the base to the cantilever portion second, curved portion, the cantilever portion second, curved portion extending from the cantilever portion first, linear portion to the cantilever portion third, linear portion, the cantilever portion third, linear portion extending from the cantilever portion second, curved portion to the contact portion.

6. The electrical terminal of claim 5, wherein the contact portion has a contact portion first, curved portion extending from the cantilever portion third, linear portion to the tail portion.

7. The electrical terminal of claim 6, wherein the spring finger contact has the first end and the second end; and wherein the tail portion has the tail portion first, linear portion, the tail portion second, curved portion, and the tail portion third, linear portion, the tail portion first, linear portion extending from the contact portion first, curved portion to the tail portion second, curved portion, the tail portion second, curved portion extending from the tail portion first, linear portion to the tail portion third, linear portion, the tail portion third, linear portion extending from the tail portion second, curved portion to the second end of the spring finger contact.

8. The electrical terminal of claim 6, wherein the spring finger contact has the first end and the second end; and wherein the tail portion has a tail portion first, curved portion extending from the contact portion first, curved portion to the second end of the spring finger contact.

9. The electrical terminal of claim 1, wherein the spring finger contact has the first end and the second end;

wherein the cantilever portion has a cantilever portion first, linear portion, a cantilever portion second, curved portion, and a cantilever portion third, linear portion, the cantilever portion first, linear portion extending from the terminal head to the cantilever portion second, curved portion, the cantilever portion second, curved portion extending from the cantilever portion first, linear portion to the cantilever portion third, linear portion, the cantilever portion third, linear portion extending from the cantilever portion second, curved portion to the contact portion; and wherein the contact portion has a contact portion first, curved portion extending from the cantilever portion third, linear portion to the second end of the spring finger contact.

10. An electrical connector assembly comprising:

an electrical connector housing having a first end, a second end, a base, and a cover, the base having a passageway extending from the first end of the electrical connector housing toward the second end of the electrical connector housing, the cover moveable between an open position and a closed position relative to the base; and an electrical terminal having a teiniinal head and an electrical contact, the terminal head disposed within the passageway of the electrical connector housing, the electrical contact extending from the terminal head and having a lengthwise axis and a spring finger contact, the spring finger contact moveable relative to the terminal head between a first position and a second position, the spring finger contact in the first position when the cover is in the open position, the spring finger contact in the second position when the cover is in the closed position, the spring finger contact having a cantilever portion and a contact portion, the cantilever portion extending away from the terminal head and away from the lengthwise axis of the electrical contact, the contact portion extending from the cantilever portion;

wherein either:

said electrical connector assembly further comprises an electrically conductive structure disposed within the electrical connector housing between the base and the cover, the electrically conductive structure having an electrically conductive trace contacting the contact portion when the cover is in the closed position, the base defines a cover recess and the cover defines a projection, the projection disposed within the cover recess when the cover is in the closed position, and the electrically conductive structure is disposed within the cover recess and defines a plurality of curves between the base and the cover when the cover is in the closed position;

the electrical contact has a support, and the spring finger contact has a tail portion extending from the contact portion and contacting the support when the spring finger contact is in the second position; or the electrical contact has a support, and the spring finger contact has a first surface and a second surface, the second surface opposably facing the first surface, the first surface adapted to contact an electrically conductive structure and contacting the support when the spring finger contact is in the second position.

11. The electrical connector assembly of claim 10, further comprising the electrically conductive structure disposed within the electrical connector housing between the base and the cover, the electrically conductive structure having an electrically conductive trace contacting the contact portion when the cover is in the closed position.

12. The electrical connector assembly of claim 11, wherein the electrically conductive structure is flat between the base and the cover when the cover is in the closed position.

13. The electrical connector assembly of claim 11, wherein the base defines the cover recess and the cover defines the projection, the projection disposed within the cover recess when the cover is in the closed position; and wherein the electrically conductive structure is disposed within the cover recess and defines a plurality of curves between the base and the cover when the cover is in the closed position.

14. The electrical connector assembly of claim 11, wherein said electrically conductive structure is a flat flexible connector.

15. The electrical connector assembly of claim 11, wherein the electrical contact has the support;

wherein the spring finger contact has the tail portion extending from the contact portion and contacting the support when the spring finger contact is in the second position.

16. The electrical connector assembly of claim 15, wherein the spring finger contact has the first surface and the second surface, the second surface opposably facing the first surface, the first surface contacting the electrically conductive trace when the spring finger contact is in the second position, the second surface contacting the support when the spring finger contact is in the second position.

17. The electrical connector assembly of claim 15, wherein the spring finger contact has the first surface and the second surface, the second surface opposably facing the first surface, the first surface contacting the electrically conductive trace and the support when the spring finger contact is in the second position.

18. The electrical connector assembly of claim 10, wherein the electrical contact has the support; and wherein the spring finger contact has the first surface and the second surface, the second surface opposably facing the first surface, the first surface adapted to contact an electrically conductive structure and contacting the support when the spring finger contact is in the second position.

19. An electrical connector assembly comprising:

an electrical connector housing having a first end, a second end, a base, and a cover, the base having a passageway extending from the first end of the electrical connector housing toward the second end of the electrical connector housing, the cover moveable between an open position and a closed position relative to the base;

an electrical terminal having a terminal head and an electrical contact, the terminal head disposed within the passageway of the electrical connector housing, the electrical contact extending from the terminal head and having a lengthwise axis, a spring finger contact, and a support, the spring finger contact moveable relative to the terminal head between a first position and a second position, the spring finger contact in the first position when the cover is in the open position, the spring finger contact in the second position when the cover is in the closed position, the spring finger contact having a first surface, a second surface, a first end, a second end, a cantilever portion, a contact portion, and a tail portion, the second surface opposably facing the first surface, the cantilever portion extending away from the terminal head and away from the lengthwise axis of the electrical contact, the contact portion extending from the cantilever portion, the tail portion extending from the contact portion and contacting the support when in the spring finger contact is in the second position, the tail portion having a curved portion extending from the contact portion to the second end of the spring finger contact; and a flat flexible connector disposed within the electrical connector housing between the base and the cover, the flat flexible connector having an electrically conductive trace contacting the contact portion when the cover is in the closed position;

wherein the first surface contacts the electrically conductive trace and the support when the spring finger contact is in the second position.

* * * * *